US007222778B2

(12) United States Patent
Smith et al.

(10) Patent No.: US 7,222,778 B2
(45) Date of Patent: May 29, 2007

(54) MULTIFUNCTIONAL DEVICE FOR SUPPORTING A CONTAINER LID

(76) Inventors: Ronald Brian Smith, 1575 N. Coats Rd., Oxford, MI (US) 48371; Daniel Nett, N102W17658 Stoneridge Dr., Germantown, WI (US) 53022

( * ) Notice: Subject to any disclaimer, the term of this patent is extended or adjusted under 35 U.S.C. 154(b) by 189 days.

(21) Appl. No.: 10/762,641

(22) Filed: Jan. 22, 2004

(65) Prior Publication Data

US 2004/0206806 A1 Oct. 21, 2004

Related U.S. Application Data

(60) Provisional application No. 60/463,545, filed on Apr. 17, 2003.

(51) Int. Cl.

| | |
|---|---|
| ***B65D 5/42*** | (2006.01) |
| ***A63H 33/00*** | (2006.01) |
| ***A63F 9/00*** | (2006.01) |
| *A63F 9/16* | (2006.01) |

(52) U.S. Cl. ..... 229/199; 229/116.1; 229/906; 446/71; 446/73; 446/79; 463/48

(58) Field of Classification Search ..... 229/116.1, 229/199, 906; 446/71, 73, 77, 79; 463/48
See application file for complete search history.

(56) References Cited

U.S. PATENT DOCUMENTS

| | | | | |
|---|---|---|---|---|
| 3,155,392 | A * | 11/1964 | Ruderian | 446/79 |
| 4,877,609 | A | 10/1989 | Beck et al. | 426/87 |
| 5,077,050 | A * | 12/1991 | Wall | 426/124 |
| 5,173,070 | A * | 12/1992 | Gould | 446/79 |
| 5,366,144 | A | 11/1994 | Eisman | 229/199 |
| 5,480,031 | A | 1/1996 | Maultasch et al. | 206/525 |
| 5,509,601 | A * | 4/1996 | Drabick | 229/199 |
| 5,516,036 | A * | 5/1996 | Maultasch et al. | 229/199 |
| 5,542,540 | A | 8/1996 | Knapp et al. | 206/525 |
| 5,600,889 | A | 2/1997 | Marotta | 30/142 |
| 5,759,119 | A | 6/1998 | Ayoub | 473/387 |
| 5,887,783 | A * | 3/1999 | Prokopis | 229/199 |
| 5,934,966 | A * | 8/1999 | Ward | 446/46 |
| 6,386,440 | B1 | 5/2002 | Tulkoff | 229/120.32 |
| 6,484,407 | B2 | 11/2002 | Khatchadourian et al. | 30/319 |
| D469,016 | S | 1/2003 | Gambino | D9/499 |
| 6,694,619 | B1 * | 2/2004 | Steck et al. | 30/142 |

* cited by examiner

*Primary Examiner*—Gary E. Elkins
(74) *Attorney, Agent, or Firm*—Gifford, Krass, Sprinkle, Anderson & Citkowski, P.C.

(57) ABSTRACT

A multifunctional device for supporting a lid of a container in order to protect an item stored within the container is provided. The support device includes a generally planar upper member. The support device also includes at least one leg member detachably connected to the upper member by a connecting member and projecting from a surface of the upper member. The upper member and leg member have a first function as a lid support when the leg member and upper member are attached. Further, either one of the upper member or the leg member have a second function different from the first function when the leg member is detached from the upper member.

8 Claims, 9 Drawing Sheets

MULTIFUNCTIONAL DEVICE FOR SUPPORTING A CONTAINER LID

RELATED APPLICATION

This application claims priority of U.S. Provisional Patent Application Ser. No. 60/463,545 filed Apr. 17, 2003, which is incorporated herein by reference.

FIELD OF THE INVENTION

The present invention relates generally to packaging and, more specifically, to a multifunctional device for supporting a lid portion of a semi-rigid container to protect the contents within the container.

BACKGROUND OF THE INVENTION

Various types of containers are well known in the packaging art for holding an item. In general, the size, shape and material of the container are dependent on the item to be contained within the container. The container may also include other specifications, such as that the container protects the integrity of the item contained therein. For example, the lid portion of the container does not touch a food item contained therein.

A frequently used shape for a container is a box shape. Likewise, a frequently utilized material for a box is cardboard. Various factors influence the cost of the container, including the amount of the material used in the container. The rigidity of the cardboard box is dependent on the density of the cardboard material, and the more dense the material, the higher the cost. If the container is meant to be disposable, such as with a food container, there may be a tradeoff between container cost and functionality. For example, with a container used to hold a food product, such as a pizza, the material cost of the pizza box is balanced by the need that the pizza box lid avoid contact with the pizza contained therein.

Various support devices are known in the art for supporting the lid of a pizza container. One example of such a support device is a support having three legs supporting a generally planar top portion. While this device works well in supporting the lid, it has no other use. Another example of a support device is disclosed in U.S. Pat. No. 4,877,609. This patent discloses a combination lid support and food server for serving the contents contained within the box. This device provides for lid support, and another use as a pizza server. Another example is disclosed in U.S. Pat. No. 5,600,889, which is a detachable spacer attached to the lid of the container. This device only provides for support of the lid. Still another device is disclosed in U.S. Pat. No. 5,759,119. This device is a golf tee for holding the lid of a pizza box. The golf tee is attached to the lid of the box and is detachable for later use as a golf tee. While these devices work, they are generally disposable or have an extremely limited secondary use.

Thus, there is a need in the art for a low cost lid support device for a container made of cardboard material having multiple purposes, including a first use as a lid support and an unrelated secondary useful purpose.

BRIEF DESCRIPTION OF THE INVENTION

Accordingly, the present invention is a multipurpose device for supporting the lid of a container in order to protect an item stored within the container. The device includes a generally planar upper member. The device also includes a leg member detachably connected to the upper member by a connecting means and projecting from a surface of the upper member. The device has a first use as a lid support and the leg member is detachable from the upper member for a second use that is different from the first use.

One advantage of the present invention is that a multifunctional support device for a container is provided that is low cost to produce. Another advantage of the present invention is that a multifunctional support device is provided with a detachable leg member, so that either one of the separated leg member or upper member have a useful secondary purpose. Still another advantage of the present invention is that a multifunctional support device is provided that is not attached to the container. Yet still another advantage of the present invention is that a multifunctional support device is provided having a visible indicia, such as letters, or numbers, or objects, a logo, or the like. A further advantage of the present invention is that a multifunctional support device is provided having an upper member with a circular shape, and a leg member shaped like a golf tee, so that the leg member detaches from the support member for a second use as a golf tee, and the upper member may have a second use as a golf marker, respectively. Still a further advantage of the present invention is that a multifunctional support device is provided having a support member with a U-shape, and a leg member shaped like a hockey stick, so that the leg member detaches from the support member for secondary use as a hockey stick and net, respectfully. Yet still a further advantage of the present invention is that a multifunctional support device is provided having a support member for holding a food item, and a detachable leg member, so that the leg member detaches from the support member for secondary use of the support member as a container. An additional advantage of the present invention is that a multifunctional support device is provided having first use as a lid support for a pizza box and a second unrelated use such as a miniature game, or souvenir or jewelry item or the like.

Other features and advantages of the present invention will be readily appreciated, as the same becomes better understood after reading the subsequent description taken in conjunction with the accompanying drawings.

DETAILED DESCRIPTION OF THE PREFERRED EMBODIMENTS

Referring to FIGS. 1–35, a multifunctional support device 10 for supporting a lid portion 54 of a container 50 is illustrated. The multifunctional support device 10 has a first use as a support for the lid 54 of a container 50 and a second, non-support related use. One example of a second use is a miniature game, such as hockey, soccer, baseball, football, basketball or the like. Another example of a second use is a toy such as a flying disk, spinning top, or miniature furniture. Still another example of a second use is a souvenir item. The souvenir item may be worn as a piece of jewelry. A further example of a second use is a container. The support device can also have a second use as a promotional product and include a predetermined indicia, such as letters, or numbers, or objects, or the like. The second uses suggested herein are merely a few examples of second uses and other second uses are contemplated.

Figure 35:
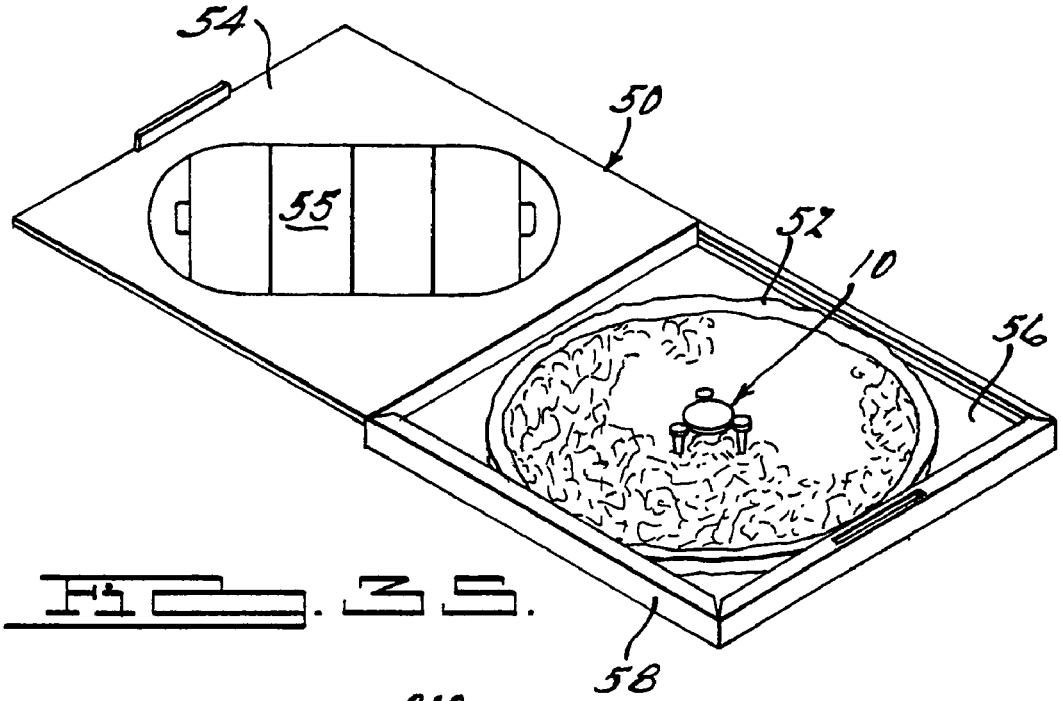
FIG. 35 is a perspective view of a container with a multifunctional support device according to the present invention.

Preferably, the container 50 is utilized to contain a food product 52, as shown in FIG. 35. It should be appreciated that in this example, the food product 52 is a pizza and the container 50 is a box, such as a box typically utilized in transporting a pizza. Other types of containers and contents are foreseeable for use with the multifunctional support device, to be described. The container generally includes a lid portion 54, an opposed bottom portion 56, and a side portion 58 extending therebetween the lid portion 54 and the bottom portion 56. In one example, the lid portion 54, bottom portion 56 and side portions 58 are integrally formed from one piece of material. In another example, the lid portion 54 and bottom portion 56 are each separable. Preferably, the container 50 is formed from a material that is rigid enough to protect the contents of the container, such as cardboard, and still be cost-effective. Advantageously, the lid portion 54 may include a portion containing an indicia 55 to facilitate the use of the support device 10. For example, the indicia 55 may represent a game playing surface, such as an ice rink or a football field or the like.

The support device 10 is advantageously placed in the container 50 so as to support the lid portion 54 of the container 50. At the same time, the support device preserves the integrity of the contained food product 52 by ensuring that the lid 54 of the container 50 does not come into contact with the item contained therein.

Figure 1:
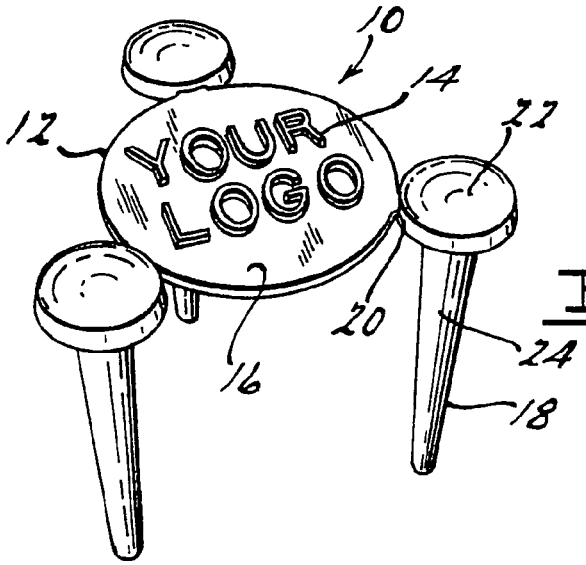
FIG. 1 is a perspective view of a multifunctional device for supporting the lid of a container, according to the present invention.
Figure 2:
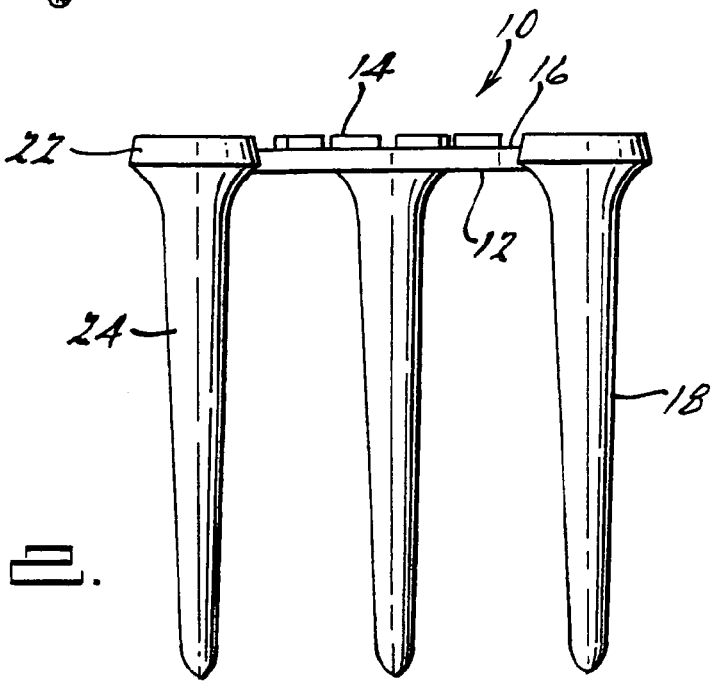
FIG. 2 is an elevational side view of the multifunctional support device of FIG. 1, according to the present invention.
Figure 3:
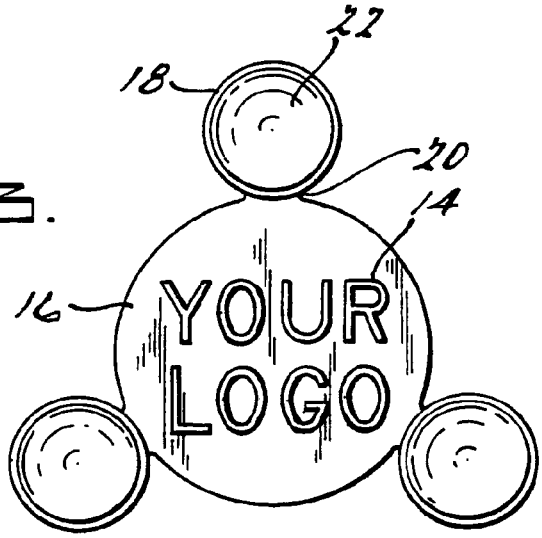
FIG. 3 is an elevational top view of the upper member for the support device of FIG. 2, according to the present invention.

The multifunctional support device 10 includes a generally planar upper member 12. In this example shown in FIGS. 1–3, the upper member 12 has a circular shape, although other shapes are contemplated. For example, the upper member may take the form of a replica of an item, or a logo. The upper member may include an indicia 14, such as a logo, or letters, or numbers, or objects, or the like, positioned on an upper surface 16. The indicia 14 may be molded or embossed onto the upper surface 16 of the upper member. Alternatively, the indicia 14 is otherwise affixed or applied to the upper surface of the upper member using an adhesive or the like, such as with a label or sticker. The upper member advantageously supports the container lid 54 so that the lid 54 does not contact the contents within the container. It should be appreciated that if the indicia 14 is raised as shown in FIG. 2, it also functions to support the container lid 54.

The multifunctional support device 10 also includes at least one leg member 18 projecting from the upper member 12. In this example, there are three leg members positioned at an outer edge of the upper member 12 and projecting radially. The leg member has an elongated shape, and a free end may form a point. The leg member 18 may also include indicia 14, such as a logo or the like. The leg member 18 is detachably connected to the upper member as shown at 20 by a connecting member. Preferably, the connecting member 20 is a thinned-out section of material. It should be appreciated that the connecting member 20 may also form a living hinge, as is known in the art to achieve the second use of the leg member 18.

The multifunctional support device 10 is preferably formed from a lightweight, moldable material. One example of such a material is plastic. Anther example of a material is an edible material or a biodegradable material. It is contemplated that the support device 10 is molded in one piece. Further, it is contemplated that the support device can be molded in multiple colors.

In this example, the leg member 18 is shaped like a golf tee, having a head portion 22 and a tapered shaft portion 24 that extends from the head portion 22 and forms a point at an end opposite the head portion 22. Also, in this example, the upper member is circular like a golf ball marker. The upper member may have a stabilizing member (not shown) extending radially from a lower surface of the upper member, to assist in positioning the ball marker on a golf course green. In this example, the head portion 22 of the leg member 18 and the upper member indicia are on the same geometric plane, to provide a support for the container lid 54.

The support device 10 may include other components to achieve the second use. It is also contemplated that the detached upper member 12 and leg member 18 may be reassembled using known connecting means 20 to achieve the second use. In addition another item may also be used with the reassembled support device to achieve the second use. For example, the inclusion of a balloon to have a second use as an air-powered vehicle.

In use, the device 10 is centrally located within the container 50. For a large container 50, more than one device 10 may be strategically placed in the container 50 to support the lid 54. The device 10 is preferably freestanding, and not attached to the lid. Advantageously, the device 10 can be utilized for multiple purposes in addition to its first use as a support for a container lid. For example, the device 10 can be used for promotional purposes to advertise a service or product or the like, using the appropriate indicia 14 on the upper member. After the device 10 is used to support the lid 54, the leg member 18 is detached from the upper member 12. The separated leg member 18 and upper member 12 now have a secondary useful function. In this example, the upper member 12 in this example now has a useful function as a golf marker, and the leg member now has a useful function as a golf tee.

Figure 4:
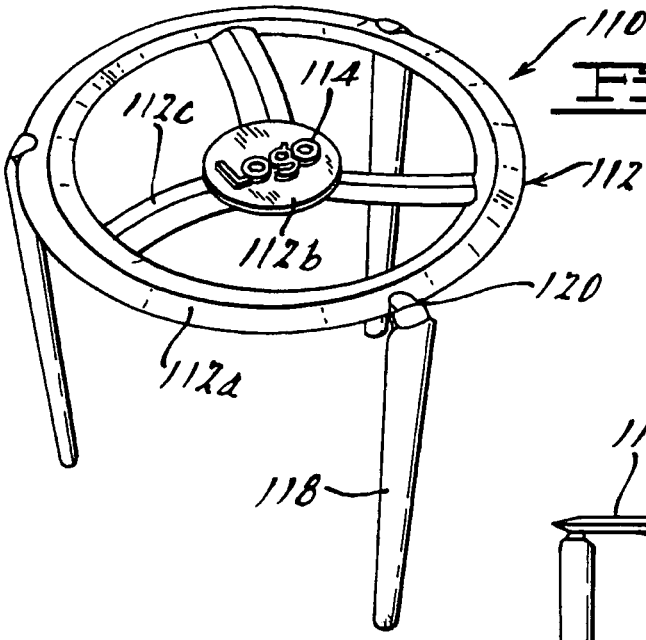
FIG. 4 is a perspective view of another embodiment of a multifunctional device for supporting the lid of a container, according to the present invention.
Figure 5:
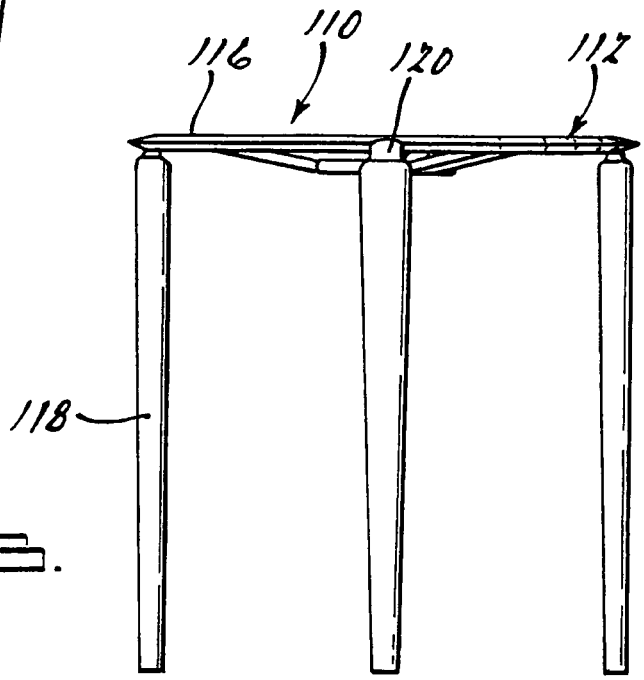
FIG. 5 is an elevational side view of the multifunctional support device of FIG. 4, according to the present invention.
Figure 6:
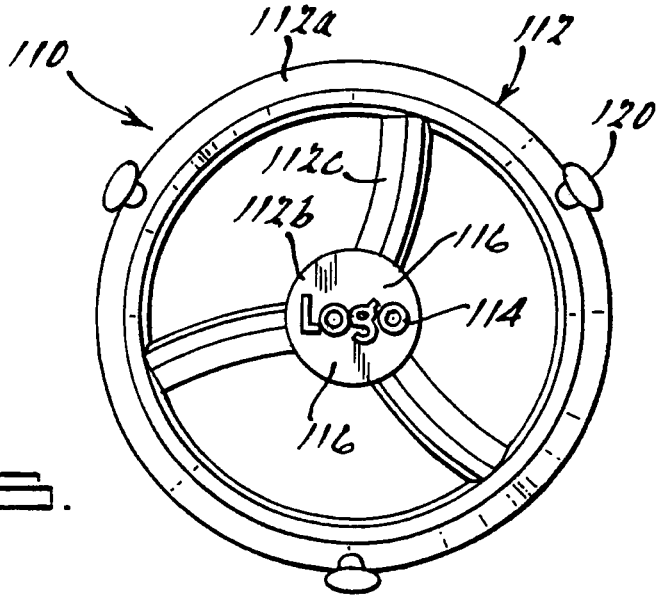
FIG. 6 is an elevational top view of the upper member for the support device of FIG. 4, according to the present invention.

Referring to FIGS. 4–6, another embodiment of a multifunctional support device 110 is illustrated. It should be appreciated that like parts have like numbers increased by 100. In this example, the upper member 112 is generally circular, and includes an outer rim portion 112*a* and an inner circle portion 112*b*, with a plurality of spoke members 112*c* interconnecting the inner circle portion 112*b* with the outer rim portion 112*a*. It should be appreciated that in this example, the upper member is shaped like a children's toy, such as a flying disc. An indicia 114 such as a logo or the like is positioned on the upper member 112. In this example, the indicia 114 is located on the upper surface 116 of the inner circle, in a manner as previously described.

The multifunctional support member 110 includes at least one detachable leg member 118 extending radially from a surface of the upper member 112. In this example, the upper member 112 extends radially from an outer edge of the outer rim, as previously described, using a connecting member 120, as previously described. It should be appreciated that when the leg members 118 are detached from the upper member 112, the upper member 112 has a secondary use as a flying device.

Figure 7:
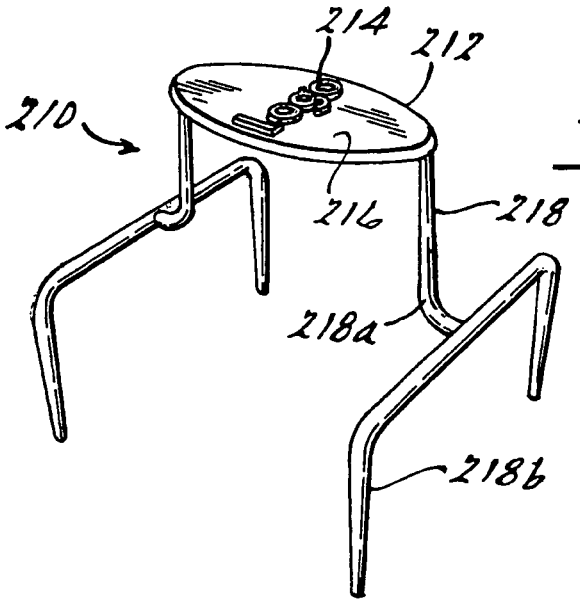
FIG. 7 is a perspective view of still another embodiment of a multifunctional device for supporting the lid of a container, according to the present invention.
Figure 8:
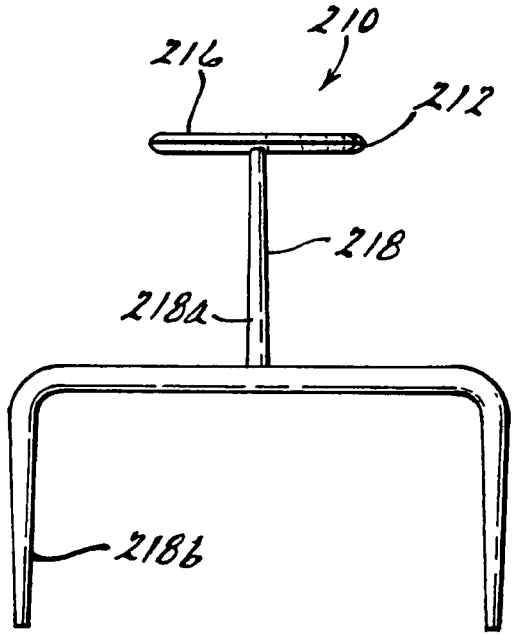
FIG. 8 is an elevational side view of the multifunctional support device of FIG. 7, according to the present invention.
Figure 9:
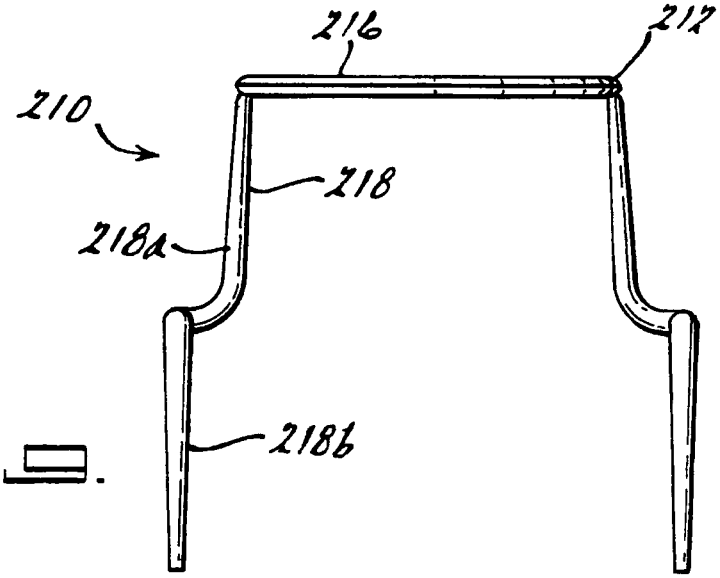
FIG. 9 is another elevational side view of the multifunctional support device of FIG. 7, according to the present invention.
Figure 10:
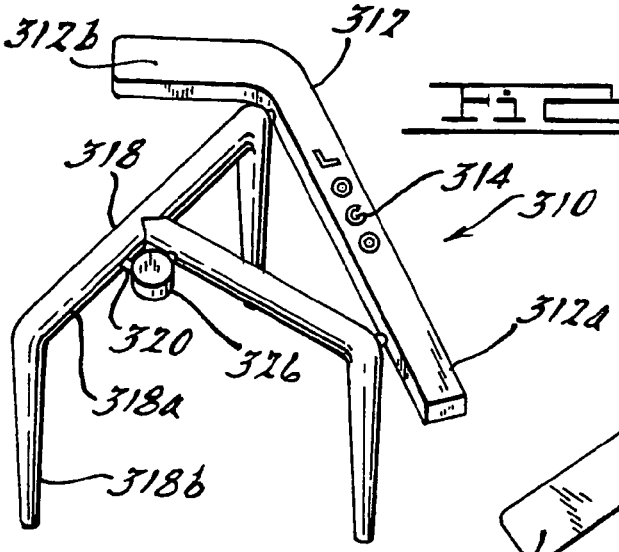
FIG. 10 is a perspective view of another embodiment of a multifunctional device for supporting the lid of a container, according to the present invention.
Figure 11:
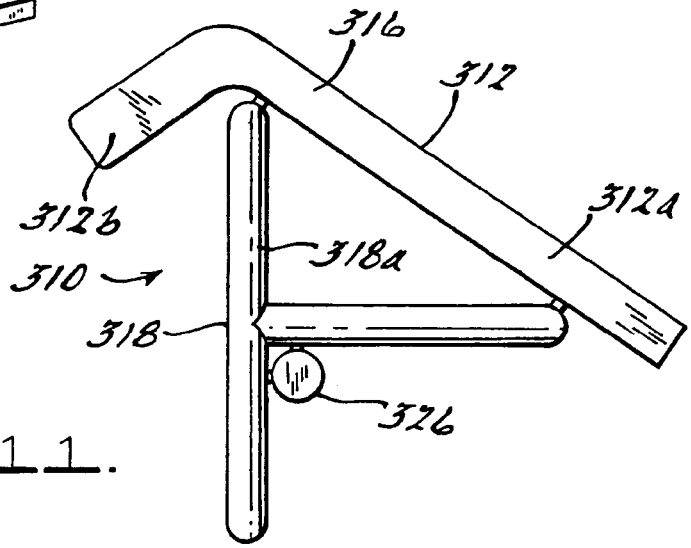
FIG. 11 is an elevational top view of the multifunctional support device of FIG. 10, according to the present invention.
Figure 12:
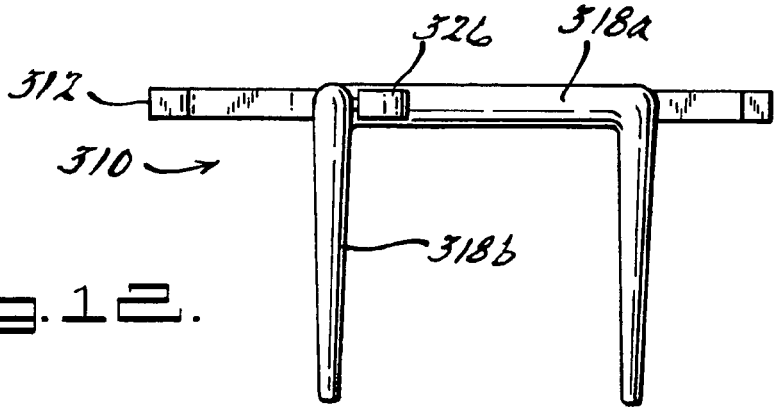
FIG. 12 is an elevational side view of the multifunctional support device of FIG. 10, according to the present invention.
Figure 13:
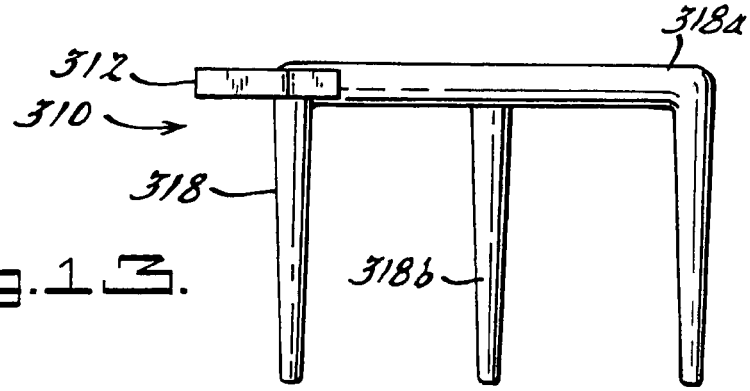
FIG. 13 is another elevational side view of the multifunctional support device of FIG. 10, according to the present invention.
Figure 14:
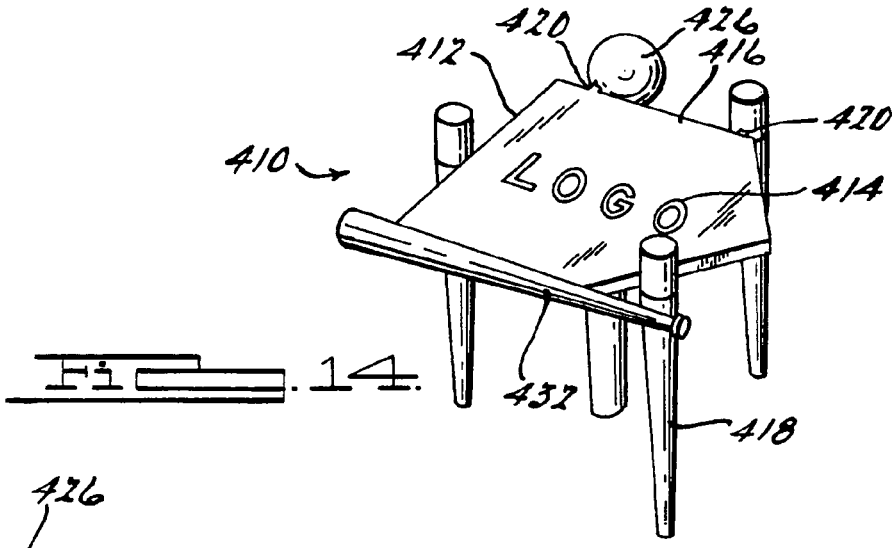
FIG. 14 is a perspective view of another embodiment of a multifunctional device for supporting the lid of a container, according to the present invention.
Figure 15:
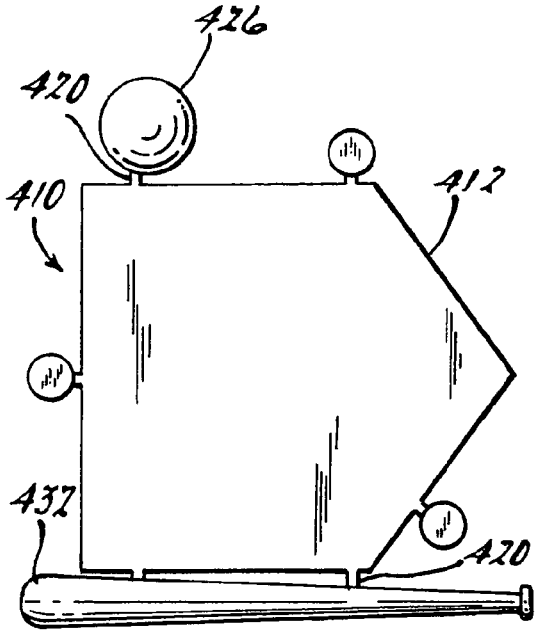
FIG. 15 is an elevational top view of the multifunctional support device of FIG. 14, according to the present invention.
Figure 16:
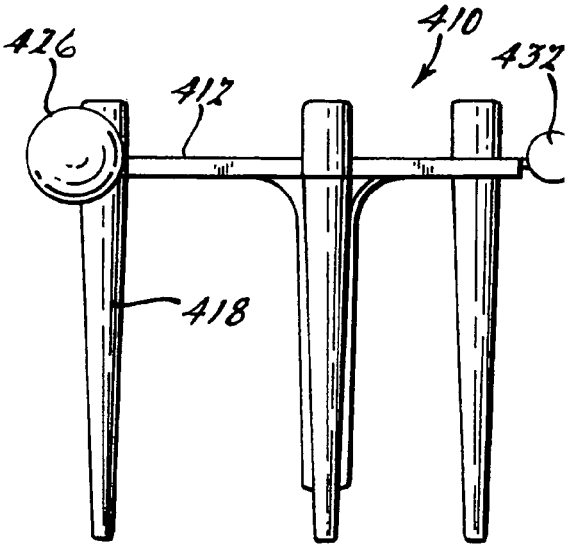
FIGS. 16–18 are elevational side views of the multifunctional support device of FIG. 14, according to the present invention.
Figure 17:
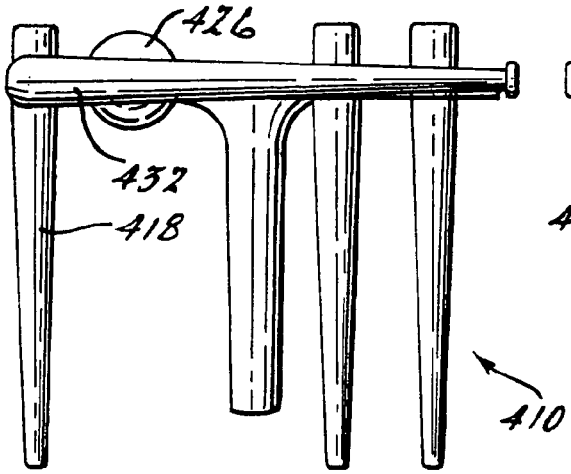
Figure 18:
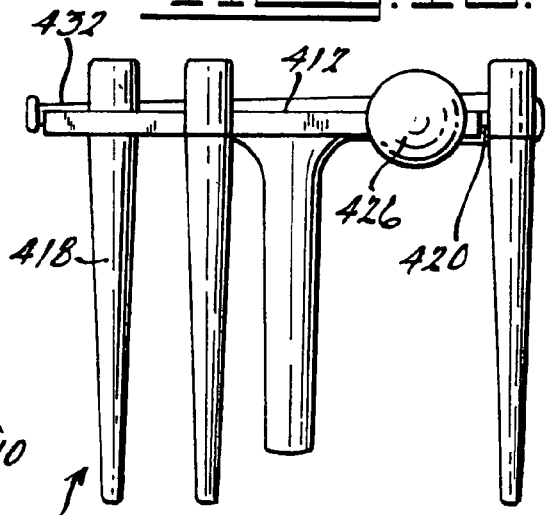
Figure 19:
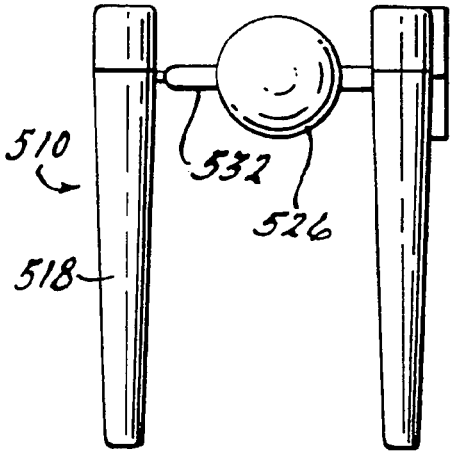
FIG. 19 is an elevational side view of another embodiment of a multifunctional device for supporting the lid of a container, according to the present invention.
Figure 20:
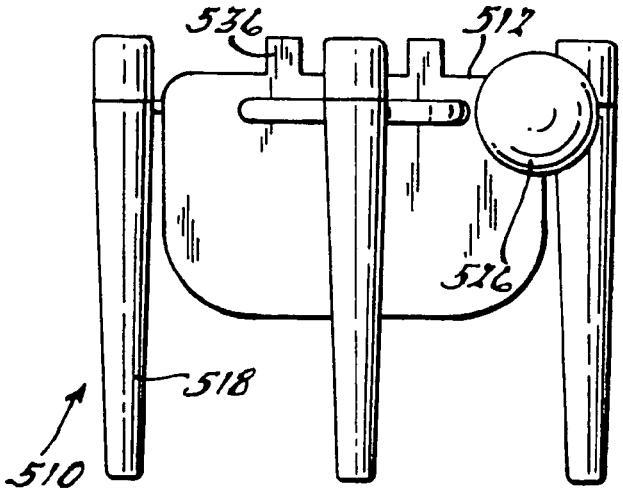
FIGS. 20–21 are elevational side views of the multifunctional support device of FIG. 19, according to the present invention.
Figure 21:
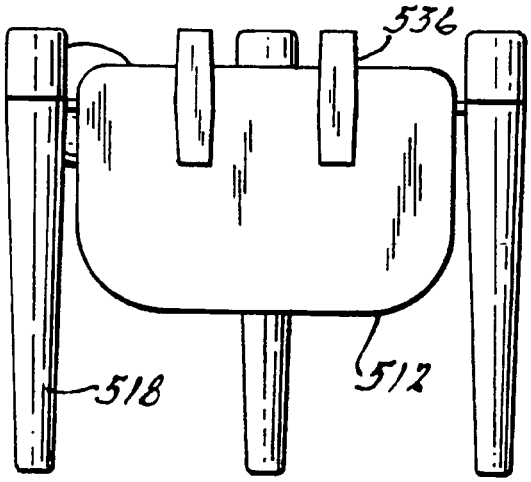
Figure 22:
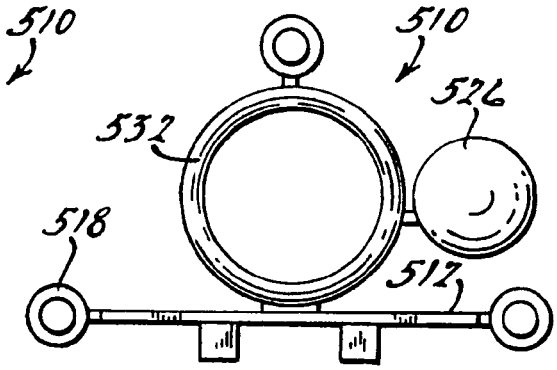
FIG. 22 is an elevational top view of the multifunctional support device of FIG. 19, according to the present invention.

Referring to FIGS. 7–9, still another embodiment of a multifunctional support device 210 is illustrated. It should be appreciated that like parts as described with respect to FIG. 1 have like reference numbers increased by 200. In this example, the upper member 212 is generally circular and planar. It should be appreciated that in this example, the upper member 212 is shaped like a ball used for a sport, such as a football, or a soccer ball, or a baseball, or a tennis ball, or the like. An indicia 214 is positioned on the upper member 212, which in this example is on the upper surface 216.

The multifunctional support member 210 includes two detachable leg members 218, both projecting from a surface of the upper member 212. In this example, each leg member 218 extends radially from an outer edge of the upper member 212 and includes a vertically extending section 218*a* that is joined to a U-shaped section 218*b* at a lower end of the vertically extending section 218*a*. It should be appreciated that when each of the leg members 218 are detached from the upper member 212, the upper member 212 has a secondary use as a ball, which in this example is a football, and the leg member 218 has a secondary use as a goalpost. Thus, the support member has a secondary use as a miniature ball game, such as a football game, or other such ball game.

Referring to FIGS. 10–13, yet still another embodiment of a multifunctional support member 310 is provided. It should be appreciated that like parts as described with respect to FIG. 1 have like reference numbers increased by 300. In this embodiment, the upper member 312 has a generally elongated rectangular shape with one end curved, so as to resemble a hockey stick. As is known in the art, a hockey stick has a straight, rectangular portion 312*a* and a curved lower portion 312*b*. The upper member 312 may include an indicia 314, as previously described on an upper surface 316. The detachable leg member 318 includes a horizontally oriented "T" shaped portion 318*a* and a vertically extending section 318*b* extending radially from an outer edge of each "T" portion. It should be appreciated that the leg member 318 forms the shape of a goal net. The support member 310 also includes a detachable third member 326. In this example, the detachable third member is detachably connected to the upper member 312 using a connecting means 320, and has a cylindrical shape, like a hockey puck. The third member may also have a circular shape. The upper member 312, third member 326 and leg member 318 are each detachable to form a hockey stick, puck and a goal respectively for a secondary use as a miniature hockey game.

In a similar manner, the support device can have a secondary use as a miniature soccer game if the upper member is shaped like a soccer ball and the leg member has the previously described goal net shape. Likewise, the support member can have a secondary use as a lacrosse game, with the upper member shaped like a lacrosse stick, the third member as a ball and the leg member shaped like the previously described goal net. Other examples of ball games are similarly contemplated.

Referring to FIGS. 14–18, yet still another embodiment of a multifunctional support member 410 is provided. It should be appreciated that like parts as described with respect to FIG. 1 have like reference numbers increased by 400. In this embodiment, the upper member 412 has a generally planar pentagonal shape. The upper member 412 may include an indicia 414, as previously described, and an upper surface 416. The detachable leg member 418 has a tapered cylindrical shape. It should be appreciated that the leg member 418 forms a baseball tee. The support member 410 also includes a detachable third member 426. In this example, the detachable third member 426 is detachably connected to the upper member 412 using a connecting member 420, and has a round three-dimensional shape, like a ball. The support member 410 may also include a detachable fourth member 432 having an elongated cylindrical shape that is tapered, like a bat. The upper member 412, third member 426, fourth member 432, and leg member 418 are each detachable to form a home plate, ball, bat and tee respectively for a secondary use as a miniature baseball game.

Figure 23:
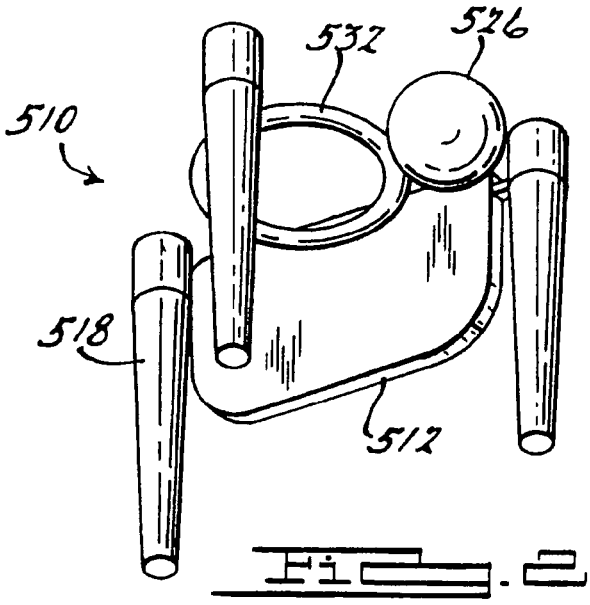
FIG. 23 is a perspective view of the multifunctional support device of FIG. 19, according to the present invention.
Figure 24:
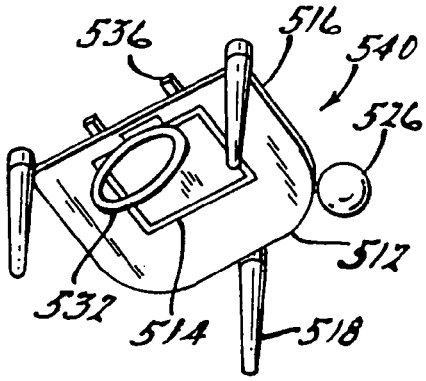
FIG. 24 is a perspective view of another embodiment of the multifunctional support device of FIG. 19, according to the present invention.
Figure 25:
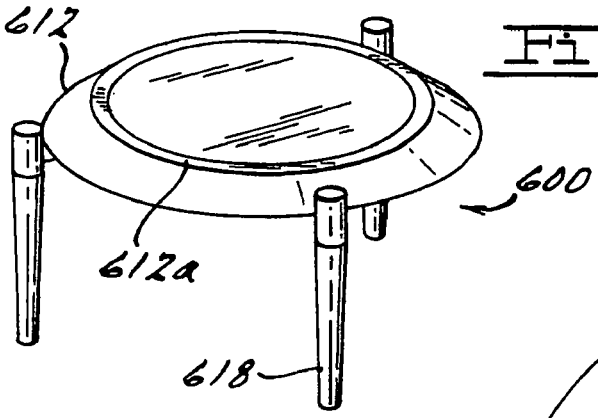
FIG. 25 is a perspective view of another embodiment of a multifunctional device for supporting the lid of a container, according to the present invention.
Figure 26:
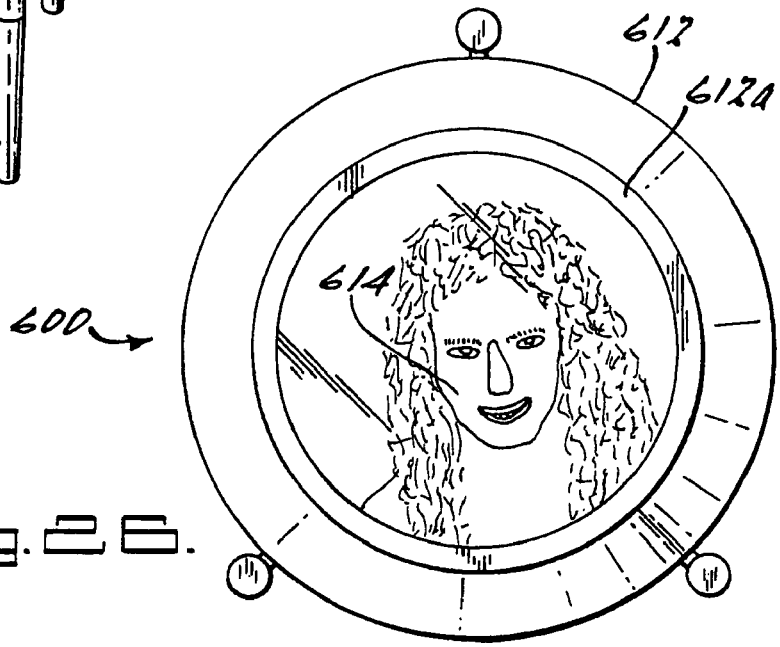
FIG. 26 is an elevational top view of the multifunctional support device of FIG. 25, according to the present invention.
Figure 27:
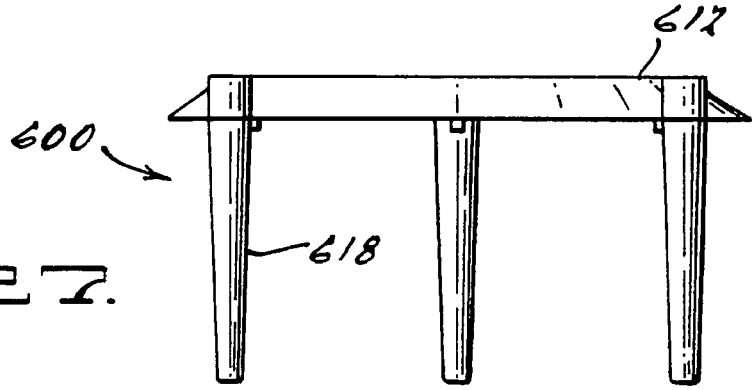
FIGS. 27–28 are elevational side views of the multifunctional support device of FIG. 25, according to the present invention.
Figure 28:
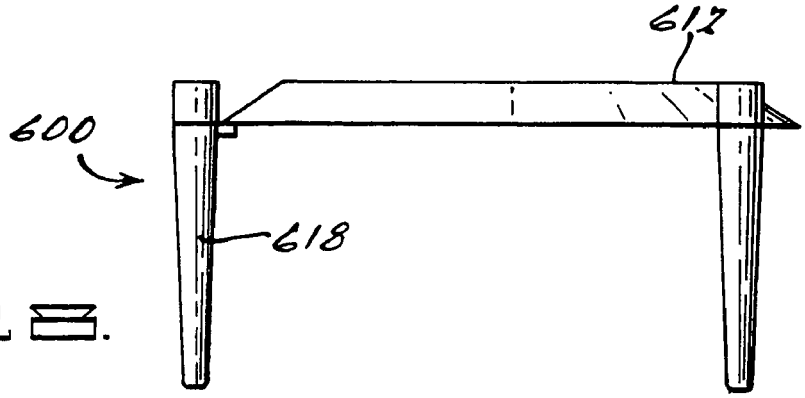
Figure 29:
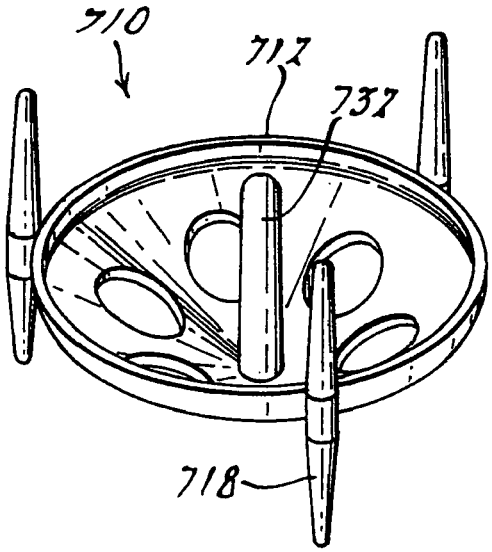
FIG. 29 is a perspective view of another embodiment of a multifunctional device for supporting the lid of a container, according to the present invention.
Figure 30:
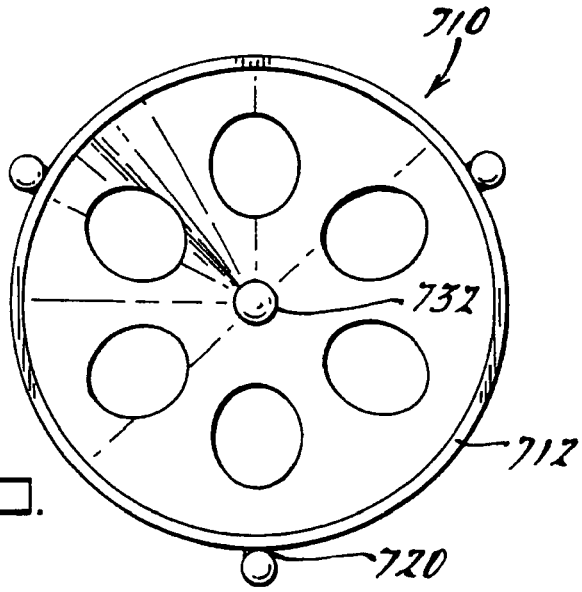
FIG. 30 is an elevational top view of the upper member for the support device of FIG. 29, according to the present invention.
Figure 31:
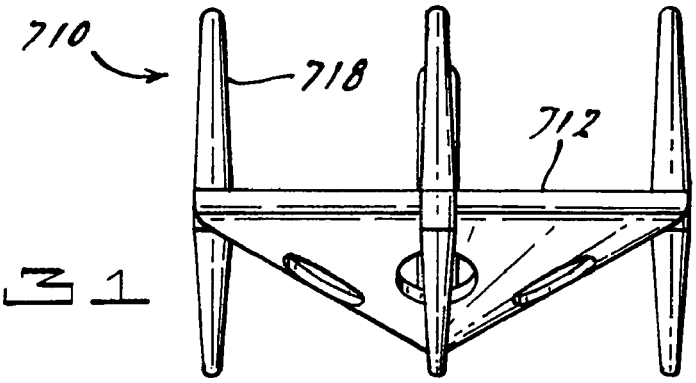
FIGS. 31–32 are elevational side views of the multifunctional support device of FIG. 29, according to the present invention.
Figure 32:
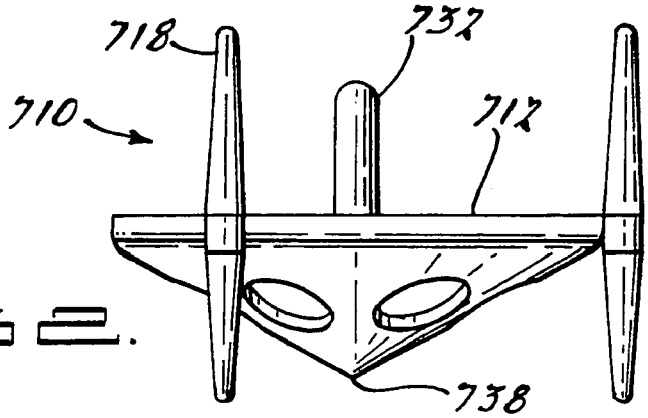

Referring to FIGS. 19–24, yet still another embodiment of a multifunctional support member 510 is provided. It should be appreciated that like parts as described with respect to FIG. 1 have like reference numbers increased by 500. In this embodiment, the upper member 512 has a generally planar shape. In particular, the upper member 512 is shaped like a rectangle, and may have rounded corners. The upper member 512 may include an indicia 514, as previously described. The upper member may also include at least one and preferably two elongated members 536 extending beyond the edge of the upper member 512 for a purpose to be described. The detachable leg member 518 has a tapered cylindrical shape. The connecting member 520 detachably connects the leg member 518 to the upper member 512. It should be appreciated that the leg member 518 detaches and connects to the upper elongated member 536, in order to support the upper member 512. The support member 510 also includes a detachable third member 526. In this example, the detachable third member is detachably connected to the upper member 512, and has a round three-dimensional shape, like a ball. The support member may also include a fourth member 532 having a ring shape. The upper member 512, third member 526, and leg member 518 are each detachable to form a backboard and stand for use as a miniature basketball game. The support device 510 can be arranged as shown in FIG. 23, with the upper member 512 oriented vertically and the head portion 522 of the leg member 518 and an end of the extending member forming the support surface for the support device 510. Alternatively, the support device 510 can be arranged as shown in FIG. 24, with the upper member 512 oriented horizontally and the head portion 522 of the leg member 518 and the upper member upper surface 516 forming the support surface for the support device 510.

Referring to FIGS. 25–28, still another embodiment of the present invention is provided. It should be appreciated that like parts as described with respect to FIG. 1 have like reference numbers increased by 600. In this example, the support device 600 has a secondary use as a picture frame. The upper member 612 has a predetermined shape, such as round, for receiving an indicia 614, such as a picture. It should be appreciated that the outer edges of the upper member 612 may be raised to decoratively form a frame portion 612*a* around outer edge of the upper member 612. A picture may be secured to the upper member 612 within the frame portion. The backside of the upper member 612 may include a securing means (not shown), such as a magnet or a hook or adhesive or the like, for securing the picture frame to another metal object after detaching the legs 618.

Referring to FIGS. 29–32, still another embodiment of the present invention is provided. It should be appreciated that like parts as described with respect to FIG. 1 have like reference numbers increased by 700. In this embodiment, the support device 710 includes an upper member 712 having a conical shape, like a top. It should be appreciated that an upper end of the upper member may include an axially extending holding portion 732, and a lower end of the upper member may form an axially extending spinning portion as shown at 738. After the leg members 718 are detached by the connecting means 720, the upper member 712 has a second use as a top or such spinner type toy.

Figure 33:
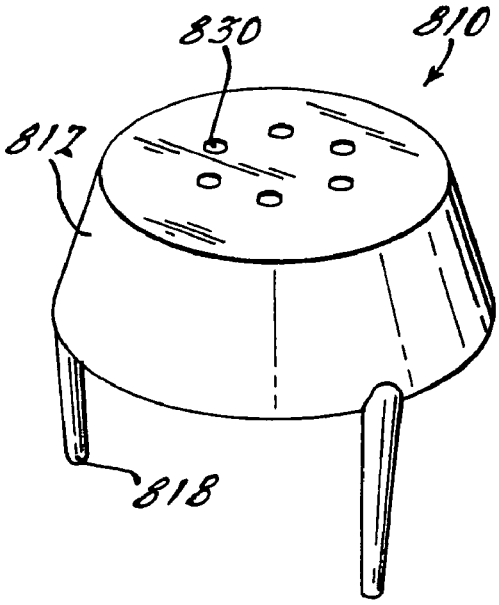
FIGS. 33–34 are perspective views of a further embodiment of a multifunctional device for supporting the lid of a container, according to the present invention.
Figure 34:
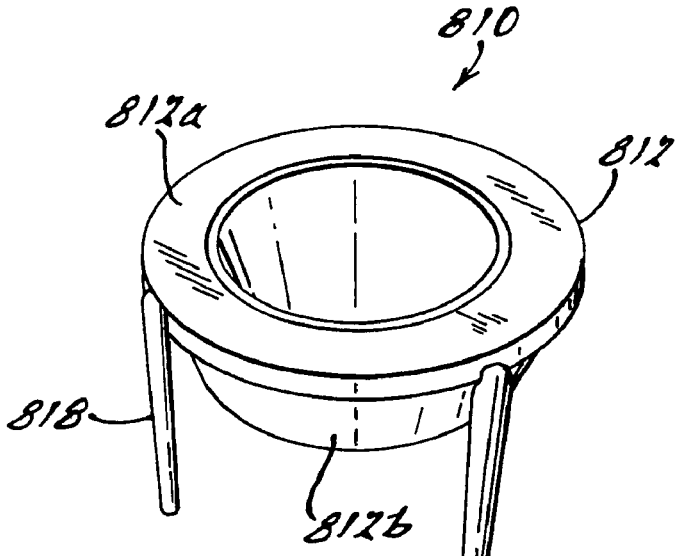

Referring to FIGS. 33 and 34, a further embodiment of the present invention is provided. It should be appreciated that like parts as described with respect to FIG. 1 have like reference numbers increased by 800. In this example, the support device 810 includes an upper member 812 that provides a container, and is supported by detachable legs 818. As shown in FIGS. 33 and 34, the upper member 812 includes both a cup portion and a lid portion 828 for holding a separate item. The cup portion and lid portion may be separable or connected using a living hinge. In the example of a pizza food item, the container may hold a related food item, such as a sauce, or extra cheese or a spice. Alternatively, the lid 812*a* portion of the upper member 812 may include a plurality of apertures 830, so as to shake out the contents of the container, like a spice shaker.

It should be appreciated that many other secondary uses for the support device are contemplated in addition to the uses described herein. The upper member can also be configured as a collectable item, or a souvenir, or the like. For example, the detached upper member can be worn on a chain as part of a necklace. Alternatively, the upper surface of the upper member may include an emblem having collectable value. In another example, the secondary use of the support device may be as a support for an item such as a compact disc or digital video disc, or card or the like.

The present invention has been described in an illustrative manner. It is to be understood that the terminology that has been used is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A multifunctional device for supporting a lid of a container in order to protect an item stored within the container, said multifunctional device comprising:

a generally planar upper member;

at least one leg member detachably connected to said upper member by a connecting means and projecting from a surface of said upper member, wherein said upper member and said leg member each have a first function as a lid support when said leg member is connected to said upper member, and said detached upper member and said leg member each have related second functions that are different from the first function when said leg member is detached from said upper member;

said upper member having a circular shape with an indicia positioned on an upper surface of said upper member;

said leg member having a head portion and a tapered shaft portion extending from said head portion, such that an end of the tapered shaft portion forms a point; and the first function of said upper member and attached leg member is a lid support and the second function of said detached leg member is a golf tee.

2. A multifunctional device for supporting a lid of a container in order to protect an item stored within the container, said multifunctional device comprising:

a generally planar upper member;

at least one leg member detachably connected to said upper member by a connecting means and projecting from a surface of said upper member, wherein said upper member and said leg member each have a first function as a lid support when said leg member is connected to said upper member, and said detached upper member and said leg member each have related second functions that are different from the first function when said leg member is detached from said upper member;

said upper member having a football shape with an indicia positioned on an upper surface of said upper member;

said leg member having a vertically extending portion joined to a U-shaped portion; and the first function of said upper member and attached leg member is a lid support and the second function of said detached leg member is a goalpost and the second function of said detached upper member is a football.

3. A multifunctional device for supporting a lid of a container in order to protect an item stored within the container, said multifunctional device comprising:

a generally planar upper member;

at least one leg member detachably connected to said upper member by a connecting means and projecting from a surface of said upper member, wherein said upper member and said leg member each have a first function as a lid support when said leg member is connected to said upper member, and said detached upper member and said leg member each have related second functions that are different from the first function when said leg member is detached from said upper member;

said upper member having a spherical shape with an indicia positioned on an upper surface of said upper member; and said leg member having a horizontally oriented T-shaped portion and a vertically oriented portion extending radially from each end of the "T" portion, wherein the first function of said upper member and attached leg member is a lid support and the second function of said detached leg member is a goal net and the second function of said detached upper member is a ball.

4. A multifunctional device for supporting a lid of a container in order to protect an item stored within the container, said multifunctional device comprising:

a generally planar upper member;

at least one leg member detachably connected to said upper member by a connecting means and projecting from a surface of said upper member, wherein said upper member and said leg member each have a first function as a lid support when said leg member is connected to said upper member, and said detached upper member and said leg member each have related second functions that are different from the first function when said leg member is detached from said upper member;

a third member detachably connected to said upper member, wherein said third member is a cylinder and has a second function when detached;

said upper member having an elongated rectangular shape with a curved portion at one end and an indicia positioned on an upper surface of said upper member; and said leg member having a horizontally oriented T-shaped portion and a vertically oriented portion extending radially from each end of the "T" portion, wherein the first function of said upper member and attached leg member is a lid support and the second function of said detached leg member is a goal net and the second function of said detached upper member is a stick, and the second function of said detached third member is a puck.

5. The multifunctional device of claim 4 further comprising:

a third member detachably connected to said upper member, wherein said third member is a cylinder and a second use of said detached third member is a puck;

said upper member having an elongated rectangular shape with a curved portion at one end and an indicia positioned on an upper surface of said upper member, wherein the second use of said detached upper member is a stick;

said leg member having a horizontally oriented T-shaped portion and a vertically oriented portion extending radially from each end of the "T" portion, and the second function of said detached leg member is a goal net and, wherein the first function of said support device is as a lid support device and the second function is as a miniature hockey game.

6. A multifunctional device for supporting a lid of a container in order to protect an item stored within the container, said multifunctional device comprising:

a generally planar upper member;

at least one leg member detachably connected to said upper member by a connecting means and projecting from a surface of said upper member, wherein said upper member and said leg member each have a first function as a lid support when said leg member is connected to said upper member, and said detached upper member and said leg member each have related second functions that are different from the first function when said leg member is detached from said upper member;

said upper member having a generally planar pentagonal shape;

said leg member having a cylindrical shape to have a second function as a miniature baseball tee;

a third detachable member having a tapered cylindrical shape and having a second function as a miniature bat when detached; and a fourth detachable member having a spherical shape and having a second function as a miniature ball, wherein the first function of said support device is as a lid device and the second function is as a miniature baseball game.

7. A multifunctional device for supporting a lid of a container in order to protect an item stored within the container, said multifunctional device comprising:

a generally planar upper member;

at least one leg member detachably connected to said upper member by a connecting means and projecting from a surface of said upper member, wherein said upper member and said leg member each have a first function as a lid support when said leg member is connected to said upper member, and said detached upper member and said leg member each have related second functions that are different from the first function when said leg member is detached from said upper member;

said upper member having a generally planar rectangular shape and the a second function is as a basketball backboard, wherein said upper member also includes a ring-shaped member projecting radially therefrom;

said leg member having a cylindrical shape and the second function is as a basketball pole for supporting the basketball backboard; and a third member having a spherical shape and having a second function as a basketball when detached, wherein the first function of said support device is as a lid support and the second function is as a miniature basketball game.

8. A multifunctional device having a first function for supporting a lid of a cardboard container for a pizza to protect the pizza and a second function, said multifunctional device comprising:

a generally planar upper member with an indicia positioned on an upper surface of said upper member; and at least one detachable leg member projecting radially from a surface of said upper member, said leg member having a head portion and a tapered shaft portion extending from said head portion, such that an end of the tapered shaft portion forms a point;

wherein the first function of said upper member and attached leg member is a lid support and the second function of said detached leg member is a golf tee and the second function of said detached upper member is a golf ball marker.

* * * * *